US005393600A

United States Patent [19]

Omura et al.

[11] Patent Number: 5,393,600

[45] Date of Patent: Feb. 28, 1995

[54] HIGHLY FLEXIBLE LEATHER-LIKE SHEET MATERIAL AND PROCESS FOR PRODUCING THE SAME

[75] Inventors: Yutaka Omura; Kazundo Akamata, both of Okayama, Japan

[73] Assignee: Kuraray Co., Ltd., Kurashiki, Japan

[21] Appl. No.: 210,289

[22] Filed: Mar. 18, 1994

[30] Foreign Application Priority Data

Mar. 25, 1993 [JP] Japan ..... 5-066776

[51] Int. Cl.[6] ..... B32B 3/26

[52] U.S. Cl. ..... 428/284; 428/297; 428/298; 428/304.4; 428/423.3; 428/904; 427/245; 427/246

[58] Field of Search ..... 428/283, 297, 298, 904, 428/304.4, 423.3, 284; 427/245, 246

[56] References Cited

U.S. PATENT DOCUMENTS 4,601,951 7/1986 Fertell et al. ..... 428/904
4,959,264 9/1990 Dunk et al. ..... 428/904
5,151,240 9/1992 Asano et al. ..... 428/904
5,156,900 10/1992 Nishimura ..... 428/904
5,252,379 10/1993 Huribayashi et al. ..... 428/904

*Primary Examiner*—James J. Bell
*Attorney, Agent, or Firm*—Oblon, Spivak, McClelland, Maier & Neustadt

[57] ABSTRACT

A highly flexible leather-like sheet material has a base layer of a fibrous aggregate containing a first polymer principally containing a first elastic polymer and, provided on the surface thereof, a coating layer of a second polymer principally comprising a second elastic polymer, said coating layer containing the two layers of a wet-formed porous intermediate coating layer integrated with the base layer and having a thickness of 10 to 40 μm and having continuous pores with a maximum pore diameter of 1 to 30 μm and a dry-formed porous surface coating layer having a thickness of 20 to 80 μm and having continuous pores with a maximum pore diameter of substantially not more than 20 μm and an average pore diameter of, preferably, 1 to 5 μm obtained by extracting off fine particles, the two layers both containing a softening agent.

14 Claims, No Drawings

HIGHLY FLEXIBLE LEATHER-LIKE SHEET MATERIAL AND PROCESS FOR PRODUCING THE SAME

BACKGROUND OF THE INVENTION

1. Field of the Invention

The present invention relates to a leather-like sheet material having an excellent flexibility, drape and moisture permeability, as well as a good appearance with smooth and high-quality feeling resembling natural leather, and being most suitable for grain-type apparels, various gloves, soft sports shoes and similar uses, and a process for its production.

2. Description of the Related Art

Known grain-type leather-like materials having excellent flexibility and moisture permeability include laminates of a fibrous base layer containing a porous elastic polymer and a porous coating layer principally comprising an elastic polymer or non-porous coating layer, and those comprising the former and further a layer of a non-porous coating layer on the surface of the porous coating layer. To obtain the porous coating layer for the above purpose, there are available a wet coagulation process which comprises treating an elastic polymer solution with a non-solvent for the polymer to coagulate it into a porous structure, a process which comprises preparing a composition by mixing an elastic polymer solution with readily extractable fine particles, e.g. salts, starch and gelatin, applying the composition on a base, followed by drying, and then extracting off the fine particles, a process which comprises kneading an elastic polymer with the above readily extractable fine particles, forming the obtained blend into a sheet and then extracting off the fine particles, a dry foaming process and the like.

Besides, Japanese Patent Application Laid-open Nos. 91279/1990, 169777/1990 and 307987/1990 propose a process which comprises forming on the surface of a wet-formed finely porous layer a polyurethane resin layer containing fine particles of a water-soluble natural polymer such as gelatin or starch and then dissolving off the water-soluble fine particles, to form a porous coating layer.

Various leather-like sheet materials having good flexibility and moisture permeability have been proposed, but none of them is suited for preparing high-quality grain-type apparels and various gloves that require excellent flexibility, drape and moisture permeability, as well as appearance with high-quality feeling. That is, with the above process of providing a surface layer of a wet-formed porous film, obtaining a smooth surface with the wet-formed film alone requires a large thickness of the film, thereby impairing the hand, while providing a finishing layer of a non-porous dry-formed film on the wet-formed porous film hardens the surface layer, whereby the surface layer tends to become ill balanced with the base layer and the resulting product loses the feeling of an integral body. On the other hand, with the above dry process of providing a non-porous or porous film, which can be relatively thin, the resulting articles lack a high-quality feeling on their surface and have an insufficient flexibility and drape for apparels and various gloves, as well as insufficient moisture permeability. With the above process of forming on the surface of a wet-formed finely porous layer a polyurethane resin layer containing fine particles of a water-soluble natural polymer and then dissolving off the water-soluble fine particles, the obtained wet-formed finely porous layer has a large thickness and a large pore size due to the water-soluble fine particles having a large particle diameter, thereby showing too poor flexibility and drape, as well as too low moisture permeability, to be used for thin-type apparels and various gloves.

Accordingly, an object of the present invention is to solve the above problems and provide a leather-like sheet material having an excellent flexibility and drape, a high moisture permeability of at least 4,000 g/m$^2$·24 hr and a smooth appearance with high-quality feeling resembling that of natural leather.

Another object of the present invention is to provide a process for producing the above leather-like sheet material.

SUMMARY OF THE INVENTION

As a result of an intensive study focussed on the structure of the surface layer, the present inventors have found that forming on a porous surface layer a porous dry-laid film by extracting off specific fine particles realizes a leather-like sheet material having all of the above features.

Thus, the present invention provides a highly flexible leather-like sheet material comprising a base layer comprising a fibrous aggregate containing a first elastic polymer and, provided on the surface thereof, a coating layer of a second elastic polymer, said coating layer comprising the two layers of a wet-formed porous intermediate coating layer integrated with said base layer and having a thickness of 10 to 40 μm and having continuous pores with a maximum pore diameter as observed on the cross-section taken in the thickness direction thereof of 1 to 30 μm and a dry-formed porous surface coating layer having a thickness of 20 to 80 μm and having continuous pores with a maximum pore diameter as observed on the cross-section taken in the thickness direction thereof of substantially not more than 20 μm obtained by extracting off fine particles, said two layers both containing a softening agent.

The present invention also provides a process for producing highly flexible leather-like sheet materials, which comprises the steps of:

(a) forming a sheet-like fibrous aggregate;

(b) impregnating the fibrous aggregate with a composition liquid comprising a first elastic polymer and then wet coagulating the composition liquid, to form a base layer;

(c) applying on the surface of the fibrous aggregate a second composition liquid comprising a second elastic polymer and conducting wet coagulation thereof, to form a wet-formed porous intermediate coating layer on the surface of and integrated with the base layer containing the first elastic polymer, said intermediate coating layer having a thickness of 10 to 40 μm and having continuous pores with a maximum pore diameter as observed on the cross-section taken in the thickness direction thereof of 1 to 30 μm;

(d) applying on a release paper a third composition liquid comprising a solution of a third elastic polymer and, mixed therewith, hot water-extractable fine particles, patching the paper with the liquid on the intermediate coating layer formed above, drying the liquid and peeling off the release paper, to form a dry-formed film;

(e) treating the thus formed film with hot water to extract off the hot water-extractable fine particles, to convert the film into a dry-formed porous surface coating layer having a thickness of 20 to 80 μm and having continuous pores with a maximum pore diameter as observed on the cross-section taken in the thickness direction thereof of 0.5 to 20 μm; and (f) applying a softening agent at least to the wet-formed porous intermediate coating layer and the dry-formed porous surface coating layer.

DETAILED DESCRIPTION OF THE PREFERRED EMBODIMENTS

The term "fibrous aggregate" herein means any sheet material comprising fibers, filaments, fibrils or like fibrous articles (hereinafter these items, inclusively, are simply referred to as "fibers") and having a sufficient air permeability, including nonwoven, woven and knit fabrics. With woven or knit fabrics, they are preferably have a nap on at least one surface thereof in view of surface smoothness. Particularly preferred among the above, in view of good flexibility and like properties, are nonwoven fabrics, which may be laminated with woven or knit fabrics or the like for reinforcement and like purposes.

The fibers used for the fibrous aggregate that constitutes a base layer for the leather-like sheet material of the present invention can be appropriately selected, depending on the intended use, from ordinary fibers, e.g. synthetic fibers such as those from polyesters, polyamides, polyacrylonitrile, polyolefins and polyvinyl alcohol; chemical fibers, such as those from regenerated cellulose, and natural fibers; or from specially configurated fibers, e.g. ultrafine fibers from polyesters and polyamides, ultrafine fiber-bundle type fibers obtained from multi-component fibers consisting of at least 2 resins having different solubilities or degradabilities by dissolving or degrading off at least one component of the resins, and special porous fibers. It is desirable to use ultrafine fibers or ultrafine fiber-bundle type fibers having a single fiber fineness of 0.1 to 0.0001 denier comprising a polyester or polyamide, in particular polyamide, in view of the flexibility and drape of the resulting sheet material. The fibers used are desirably those having been manufactured under as mild drawing conditions as possible within limits not to adversely affect the fiber strength. Such mildly drawn fibers can give softer sheet materials.

The fibers are formed into the intended fibrous aggregate that may be a nonwoven fabric bonded by fiber entanglement by needle punching or high speed water jetting, a napped knit or woven fabric, a laminate of a nonwoven fabric and a knit or woven fabric or the like. Where ultrafine fiber-bundle type fibers or special porous fibers are used, it may be difficult to form a fibrous aggregate from the finished fibers. It is therefore desirable to form an fibrous aggregate using multi-component fibers that have not been subjected to removing off of a component thereof, impregnate the aggregate with an elastic polymer and then converting the fibers into the finished fibers. The weight of the fibrous aggregate is not specifically limited, and it is suitably selected depending on the intended use, generally from the range of 100 to 1,000 g/m$^2$. Where the fibrous aggregate is a nonwoven fabric, it is desirable that the fabric have a weight of at least 200 g/m$^2$ in view of processability upon impregnation with an elastic polymer solution or like treatments. Upon preparation of thin-type leather-like materials for apparels and the like, it is possible to use a fibrous aggregate having a weight about twice the desired level, then impregnate it with an elastic polymer solution, to provide a wet-formed porous intermediate coating layer on each surface thereof and slicing the obtained sheet into two parts with a band knife or the like, thereby obtaining, at the same time, two base layers each coated on one surface thereof with the wet-formed porous intermediate layer. The obtained fibrous aggregate may, as required, be subjected to surface smoothening treatment by heat pressing or like known processes, prior to impregnation with a polymer solution. Where the fibers constituting the fibrous aggregate are islands-in-the-sea type multi-component fibers having a sea component of polyethylene and an island component of a polyester or polyamide, heat pressing the aggregate can provide it with excellent surface smoothness by fusion of the sea component polyethylene, which is particularly preferred. Where the fibers constituting the fibrous aggregate are not multi-component fibers convertible into ultrafine fibers by dissolving ,off of a component thereof, the elastic polymer impregnating the aggregate may adhere to the fibers, thereby stiffening the hand. To prevent this, it is desirable to cover the fiber surface with a temporary coating material such as polyvinyl alcohol, prior to the impregnation with the polymer.

Examples of elastic polymers usable for impregnating the fibrous aggregate or for coating the surface of the impregnated fibrous aggregate are polyurethanes, acrylics, acrylonitrile-butadiene copolymer, styrene-butadiene copolymer and mixtures of at least 2 members of the foregoing, among which polyurethanes are preferred in view of the hand, durability and like properties of the resulting products.

Suitable polyurethanes are thermoplastic ones obtained by reacting at least one polymer diol having an average molecular weight of 500 to 2,500, selected from for example polyester diols, polyether diols, polyesterether diols, polycaprolactone diols or polycarbonate diols; at least one organic diisocyanate selected from for example aromatic diisocyanates, aromatic triisocyanates, alicyclic diisocyanates, aliphatic diisocyanates having circular groups and triphenylmethane 4,4′,4″-triisocyanate; and a chain extender comprising a low molecular compound having at least 2 active hydrogen atoms. Suitable construction of the polyurethane to be used is appropriately so selected from the above that the resulting leather-like sheet material can meet various requirements with respect to hand, resistance to deterioration and yellowing, dyeability and the like, depending on the intended use.

The elastic polymer selected is dissolved in a solvent and, as required, a known coagulation adjusting agent, colorant and the like are added to the solution, to obtain a composition liquid for impregnation. The fibrous aggregate is impregnated with the composition liquid for impregnation and then immersed in a non-solvent for the polymer to coagulate into a porous matter. Here, water vapor coagulation is also applicable for the coagulation, instead of the above wet process. In general, however, no dry process is applicable here, since it causes the obtained sheet material to stiffen. Where the fibers constituting the fibrous aggregate comprise multi-component fibers convertible into ultrafine fiber-bundle type fibers or special porous fibers, the conversion is conducted, after impregnation and coagulation of the polymer, by treating the aggregate with a suitable solvent or degrading agent.

Then, the fibrous aggregate is provided integrally therewith with an intermediate coating layer (skin layer), which is essential to obtaining good surface smoothness, flexibility, moisture permeability and formability of fine wrinkles when slightly folded. The intermediate coating layer, being positioned between the base layer and a surface coating layer, plays the role of creating the above features and, at the same time, producing a desirable integral hand of the resulting leather-like sheet material. Without this intermediate coating layer, the base layer would adhere to a surface coating layer directly, whereby the resulting sheet material has poor smoothness as influenced by a roughened surface of the base and shows no good integral hand with poor formability of fine wrinkles when slightly folded, due to a difference of porosities between the base layer and the surface coating layer.

To provide the porous intermediate coating layer with the above features, it is necessary to control the thickness and level of sponge-like state of the layer within appropriate ranges. Thus, in the present invention, the intermediate layer has a thickness of 10 to 40 μm, preferably 15 to 30 μm, which is far smaller than the thicknesses of conventional coating layers formed by wet coagulation, i.e. several hundreds microns. With a thickness of less than 10 μm, sufficient surface smoothness cannot be obtained, while with the thickness exceeding 40 μm the hand tends to become stiff.

With respect to the size of the pores of the intermediate coating layer, it is necessary that the maximum pore size of the pores observable on the cross-section range from 1 to 30 μm, preferably from 1 to 10 μm. Upon wet coagulation of an elastic polymer, the pores that formed extend generally in the thickness direction and tend to have a maximum pore diameter of at least 1 μm. If the wet coagulation is conducted under such conditions as to make the maximum pore diameter at least 30 μm, it will become difficult to obtain an intermediate coating layer having a thickness of 10 to 40 μm. The pores extend not only inside the skin layer but partly on to the surface, thereby contributing to provision of good moisture permeability and good adhesiveness to a surface coating layer. The maximum pore diameter .of the wet-formed porous intermediate coating layer herein means the maximum width (i.e. maximum diameter) of each of long pores observed on the cross-section taken in the thickness direction of the layer in a scanning electron microscope with a magnification of at least 1,000, preferably 3,000.

The intermediate coating layer may be formed by any one of processes including one which comprises impregnating the fibrous aggregate with a first elastic polymer composition liquid, then applying, prior to wet coagulation thereof, on the surface a second elastic polymer composition liquid for the intermediate coating layer, and then conducting wet coagulation on both of the first and second composition liquids, thereby forming the base layer and the intermediate coating layer at the same time; and one which comprises impregnating the .fibrous aggregate with a first elastic polymer composition liquid, wet coagulating the liquid and then applying by bar coating, knife coating or the like and coagulating a second polymer composition liquid, followed by wet coagulation thereof. Between the above two, the former is preferable in view of integrity of the resulting intermediate coating layer with the base layer and cost. For the former case, the second composition liquid can be applied by, upon removing an excess of the first composition liquid from the fibrous aggregate after application thereof, adjusting the positioning of the doctor such that a required amount of the liquid remains on the surface (i.e. in this case the first composition liquid also plays the role of the second composition liquid); or by application on and removing off an excess of the first composition liquid completely from the fibrous aggregate and then applying the second composition liquid by bar coating or knife coating. Between these two methods, the former, being more simple and easy to control the layer thickness, is preferred. The elastic polymer constituting the intermediate coating layer is preferably a polyurethane, like with the polymer impregnating the fibrous aggregate, and selected from various polyurethanes having good compatibility with the polyurethane used for the base layer. Thus, the polyurethane to be applied here may be the same as or different from that for the base layer and the polyurethane composition liquid used here may have the same concentration as that of the first polyurethane composition liquid or different concentration therefrom. In general, the polyurethane solution to applied has a concentration equal to or higher than that of the first polyurethane composition liquid for impregnation. The sponge-like state of the intermediate coating layer is adjustable by appropriately selecting the concentration and types and amounts of additives of the polyurethane composition liquid, wet coagulating conditions such as the composition of the coagulating liquid used and coagulating temperature and the like. With higher concentration and viscosity of the polyurethane composition liquid and higher temperature and solvent concentration of the coagulating bath, the resulting sponge-like structure tends to have higher maximum pore diameter. These conditions are selected depending on the type of the polyurethane used and the like such that the maximum diameter of each pore ranges from 1 to 30 μm.

The porous surface coating layer constitutes the most important element of the present invention. The flexibility, drape, moisture permeability and high-quality feeling of appearance of the finished sheet material depend largely on the structure of the surface coating layer. Since wet-formed porous layers are insufficient in strength and like properties for a surface layer, the surface coating layer is formed by a dry process in the present invention.

Dry-formed porous films are generally obtained by a process of using a foaming agent, one of effecting reaction to produce foaming, one of using a mechanically foamed liquid for application or one of using water-extractable fine particles. However, with the above former three processes the obtained films tend to have independent, incontinuous cells and hence produce little effect of increasing the moisture permeability. In the present invention, as a result of a study on the above process of using extractable fine particles, specific conditions that have never been used before are employed, thereby achieving a novel structure having a thickness of 20 to 80 μm and having substantially no large pores with a maximum core diameter exceeding 20 μm. The leather-like sheet material of the present invention having all of the above features can thus be obtained. The distribution of the maximum pore diameters is, preferably, such that, among pores having a maximum diameter, as observable as such on an electron microphotograph with a magnification of 3,000, of at least 0.2 μm, at least 80% of the pores have a maximum diameter of not more than 10 μm, at least 30% thereof not more than 2 μm; more preferably at least 90% of the pores have a maximum diameter of not more than 10 μm and at least 50% thereof not more than 2 μm. The average of the maximum diameters is preferably in a range of 1 to 5 μm, more preferably in a range of 1 to 3 μm. The maximum pore diameter of the dry-formed surface coating layer herein means the maximum diameter of each of pores present on a cross-section taken in the thickness direction of the coating layer and observed on a scanning electron microphotograph with a magnification of at least 3,000. The determination procedure comprises picking up a part of the microphotograph with a magnification of 3,000 having an area of at least 600 $cm^2$ (corresponds to about 6,700 $\mu m^2$), identifying all of pores observable as such, i.e. those having a diameter of at least 0.6 mm (corresponds to 0.2 μm) and laying thereon a transparent sheet on which circles having a diameter of 6 mm, 30 mm and 60 mm (corresponds to 2 μm, 10 μm and 20 μm, respectively) have been drawn and determines each maximum diameter by checking whether or not the pore in question is entirely contained in any one of the circles; The number of the thus determined pores corresponding to each of the maximum diameters is counted and the ratio between the number and the total number is calculated. Most of pores on the thickness cross-section of the dry-formed porous surface coating layer according to the present invention are observed as transverse sections or inclined transverse sections of continuous tunnel-like pores and having deformed spherical or elliptical shapes with a ratio of maximum length/maximum breadth of not more than 2. There sometimes occur cases where the pores observed on the cross-section have long shapes with a ratio of maximum length/maximum breadth exceeding 2, thus being close to the longitudinal cross-sections of continuous tunnels. In these cases, the maximum breadth is taken as the maximum diameter.

With respect to the porosity of the dry-formed porous surface coating layer, it is preferably in a range of 20 to 70%, more preferably in a range of 30 to 50%. With increasing porosity, the resulting sheet material tends to become softer but poorer in mechanical strength, while with smaller porosity the material tends to have a rubber-like and highly repulsive hand. These tendencies vary, naturally, depending on the type and properties of the elastic polymer constituting the dry-formed porous layer.

With the layer-forming process of using extractable particles, the key conditions for producing excellent flexibility, moisture permeability and surface strength and agreeable touch and surface appearance are:

1) The type of the elastic polymer used and conditions of laying the layer;
2) The type and incorporation conditions of the extractable particles used; and
3) Application conditions.

These conditions are described in detail below.

1) While, as described in the above description for resins to impregnate the base layer, various elastic polymers are usable for the surface coating layer, polyurethanes are preferred in view of the hand and durability of the resulting layer. The same polyurethanes as those for the above impregnation or for the intermediate coating layer can also be used here, and their composition can be suitably selected to meet the required hand, resistance to abrasion or deterioration, resistance to yellowing, dyeability and the like, depending on the intended use of the finished leather-like sheet material. While polyurethanes for the base layer or intermediate coating layer are required to be capable of undergoing wet coagulation, those for the surface coating layer, which is a dry-formed film, need not be wet-coagulatable and are mainly required to have good durability such as abrasion resistance.

Polyurethanes used by the usual dry film formation process that comprises applying a polyurethane solution on a release paper and patching the paper on a base layer are, generally, classified into one part type ones, which are used for surface and intermediate layers, and two part type ones being used as adhesives that undergo crosslinking upon curing treatment after application. The latter plays the role of increasing the bond strength to the base layer and obtaining a high film strength of the surface layer in this conventional process. In the present invention, one part type polyurethanes, being used for the surface and intermediate layers, are also used for the surface coating layer, thus excluding use of two part type ones, the curing ,of which hinders extraction of particles and impairs the hand of the resulting entire sheet material including the base layer. The term "release paper" herein means the usual release sheet being used for preparation of man-made leather and the like and comprising a paper, film or the like and, provided on the surface thereof, a release resin, with the surface being smooth or provided with an embossed pattern.

The selected resin for the surface coating layer is dissolved in a solvent, mixed with a colorant, extractable particles and other additives, and then applied in one layer or in several layers. To obtain an agreeable appearance and touch and high strength of the surface and good adhesiveness to the skin layer, it is desirable to apply in several layers, using a different composition liquid each time is thus desirable to apply, for example, three different liquids in three layers as follows. The liquid applied at first on a release sheet contains a polyurethane, having a high modulus, which gives an agreeable touch and good surface strength, alone or mixed with, a nitrocullulose or aminoplast resin in an amount not to impair the adhesiveness. The liquid applied next preferably contains a polyurethane having a low modulus, which gives a good hand and moisture permeability, and extractable particles in a large amount within a limit not to impair the film strength badly. At last, for the layer contacting the intermediate coating layer and requiring a high adhesiveness therewith, there is used a liquid containing a reduced amount of the extractable particles and having such a viscosity as to achieve ready penetration into the intermediate coating layer. The liquid for the middle layer is applied in a larger amount than those for the surface layer and the layer contacting the intermediate coating layer. With respect to the colorant added, the same or different pigment or dye is mixed in each of the liquids for the layers.

2) With respect to materials used for extractable particles, it is necessary that they be pulverizable finely to a desired particle size and be readily soluble in water or hot water. Examples of such materials are inorganic compounds, e.g. sodium chloride and sodium sulfate, natural organic substances, e.g. gelatin and sugar, and organic compounds, e.g. polyvinyl alcohol and ammonia-modified maleic anhydride-isobutylene copolymer (for example, ISOBAN, made by Kuraray Co.). Among the above, the ammonia-modified maleic anhydride-isobutylene copolymer is the best, in view of solubility, fine pulverizability, handling ease and the like. Inorganic compounds such as sodium chloride and sodium sulfate, organic substances such as sugar and other organic compounds such as polyvinyl alcohol are not sufficiently pulverizable into fine particles and not so readily water soluble. Gelatin, having good solubility, has a large moisture absorption and is difficult to pulverize and handle.

Besides, it is important that the extractable fine particles used in the present invention be partially soluble in the solvent for the elastic polymer used and that the resulting solution be not mixed uniformly with the elastic polymer solution and undergo phase separation. That is, the continuous pores and pore size distribution of the dry-formed porous surface coating layer in the present invention cannot be obtained by simply mixing with an elastic polymer solution fine particles that are insoluble in the solvent for the elastic polymer. Dissolution of part of fine particles in the solvent for the elastic polymer makes the fine particles smaller and having their sharp edges formed upon pulverization be rounded. It, is also considered that presence of the solution of part of the fine particles with the elastic polymer solution, both being phase separated from each other, should contribute largely to formation of fine tunnel-like pores. The ratio to total of the part of fine particles dissolved in the solvent for the elastic polymer differs depending on the concentration and,viscosity of the elastic polymer solution and the particle size of the fine particles and is not specifically restricted, but it is generally such that the amount of the hot water soluble fine particles dissolved, when 10 parts by weight of the particles are added to 90 parts by weight of a solvent and the mixture is stirred at 90° C. for 30 minutes, will be in a range of 5 to 40% by weight. If the ratio is too small, fine pores will not be formed sufficiently. On the other hand, with the ratio being too large, the pores formed are too fine so that the hand tends to become stiff. It is not necessary that extractable fine particles of only one type be used and two or more types can be used admixedly. In this case, the counterpart fine particles need not necessarily be soluble in the solvent for the elastic polymer. It is also possible to use, instead of fine particles partially soluble in a solvent, extractable fine particles insoluble in the elastic polymer solution, in combination with an extractable resin that is soluble in the solution and has high affinity with the extractable fine particles, as long as the fine particles are sufficiently finely pulverizable.

The solubility in water and that in organic solvents such as dimethylformamide of the above-described maleic anhydride-isobutylene copolymer are adjustable by changing the level of ammonia modification.

The extractable fine particles suitably have an average particle diameter, which directly influences the pore size of the porous layer after extraction treatment, of 2 to 20 μm, more preferably 5 to 10 μm. With an average particle diameter of less than 2 μm, the particles tend to agglutinate; while with ones exceeding 20 μm the resulting pores become too large, thereby decreasing the film strength and impairing the surface smoothness. The extractable fine particles preferably have a particle size ranging from about 1 to 50 μm and contain at least 80% of the particles of 2 to 20 μm. Where extractable fine particles that is not partially soluble in the solvent for the elastic polymer are used together, they should have smaller particle sizes, which will not further decrease after being mixed with the elastic polymer solution. Besides, it is desirable in this case that they have as small sharp edges as possible upon pulverization. With extractable fine particles having sharp edges, the porous layer after extraction treatment tends to become fragile and have poor mechanical properties.

With respect to the amount of the extractable fine particles to be mixed with the surface coating layer resin, it is generally 0 to 50 parts by weight based on 100 parts by weight of the resin, preferably 0 to 20 parts by weight for the surface skin layer on the same basis, 100 to 300 parts by weight, preferably 150 to 250 parts by weight for the middle layer and 0 to 50 part by weight, preferably 0 to 20 parts by weight for the layer contacting the intermediate coating layer, all based on 100 parts by weight of the resin. If the amount of the extractable fine particles mixed into the surface skin layer exceeds 50 parts by weight, the pattern on the release paper used will not be clearly transferred and the fine particles will tend to adhere to the release paper. If the amount of the extractable fine particles mixed into the middle layer is less than 100 parts by weight, a sufficient porous structure will not be formed; and if it exceeds 300 parts by weight, the resulting pores will be consolidated to form macropores, which decreases the film strength. If the amount of the extractable fine particles mixed into the layer contacting the intermediate coating layer exceeds 50 parts by weight, the area of adhesion will become small after extraction treatment, which decreases the bond strength.

It is necessary upon mixing the extractable fine particles into the resin solution, that stirring be conducted sufficiently and agglutinated particles be removed by filtration, thereby preventing poor dispersion. In the present invention, since the extractable fine particles are partly dissolved to round off their sharp edges and to become finer, mixing of a large amount, for example the same amount as or even 3 times that of the resin solid matter of middle layer can still give a porous coating layer having excellent mechanical strength.

3) The procedure of the application comprises successively applying on a release paper and drying each of the above composition liquids for the surface skin layer and the middle layer, and then applying the liquid for the adhesive layer, i.e. a layer contacting the intermediate coating layer and patching on the intermediate coating layer. Here, the key points are drying conditions for the liquids and pressure condition for patching. The drying condition and patching pressure condition for each of the liquids are adjusted according to the type of the finished product such that the extractable fine particles contact each other in the thickness direction of the entire surface coating layer, thereby being capable of forming continuous pores after extraction, that the resulting pattern transferred from the release paper used on to the surface becomes clear and that the adhesive layer liquid penetrates effectively into the intermediate coating layer. If the drying condition after application of each of the liquids is too strong, which makes clear the grain on the surface though, the extractable fine particles present in each layer are fixed as they are and, when pressed upon patching, will not move and will hardly achieve a state where they contact each other, thereby failing in forming continuous pores after extraction, whereby sufficient moisture permeability and hand cannot be obtained. In this case, the adhesive layer liquid does not penetrate sufficiently into the intermediate coating layer and hence the bond strength between the surface coating layer and the intermediate coating layer decreases. On the other hand, if the drying condition is too mild, a large amount of the-extractable fine particles in the middle layer will move toward the surface skin layer, thereby causing the transferred pattern on the surface to lack clearness. If the patching pressure is too low, the extractable fine particles contained in each of the layers will move only to a small extent and the liquid will not penetrate into the intermediate coating layer sufficiently, so that a sufficient moisture permeability, a good hand and a sufficient bond strength cannot be obtained. On the other hand, too high a pressure, while giving a high bond strength, causes the liquid to over-penetrate partially or the extractable fine particles to condense on the surface skin, thereby generating poor surface smoothness and unclear grain. The sheet material whose surface has thus been formed under suitable conditions is taken up into a roll, which is then preferably aged for about 2 days, as conducted for conventional dry-formed sheet materials, in order to fix the surface layer sufficiently.

Extraction of fine particles can be conducted with any one of the usual dyeing machines, i.e. by dip-nip process, or with a zigger, wince or circular, or by like methods. However, it is recommended to use a winch or circular, which can give relaxation effect of the base layer treated. By extraction treatment at a water temperature of 60° to 100° C. for about 40 to 100 minutes almost all of the fine particles are extracted off and the base layer is sufficiently relaxed. By the extraction and relaxation treatment, the surface coating layer is converted into a dry-formed porous surface coating layer with continuous pores having a maximum pore diameter of substantially not more than 20 μm and an average maximum pore diameter of 1 to 5 μm. If gelatin particles that are not partially soluble in an elastic polymer solution and have a large particle diameter are used as extractable fine particles, dissolving off of the gelatin particles will not form in the resulting surface coating layer very fine pores as those in the present invention but only form pores whose maximum diameters are often larger than the average diameter of the gelatin-particles used.

The sheet material obtained after the extraction treatment is, as required, subjected to an additional coloring, calendering or like treatments, in combination, to provide its surface with high-quality feeling. Thereafter, in the present invention, the sheet material is treated with a softening agent. The sheet material obtained above has become, as it is, a flexible leather-like material. However, the additional treatment with a softening agent, which gives good slippage among fibers and between fibers and the resin and is contained in the cells of the porous structure, realizes a novel high-quality leather-like sheet material having an excellent flexibility, uniquely calm hand and good drape.

The softening agent treatment can be sufficiently conducted by the dip-nip process. Conventional softening agents, e.g. amino-silicone based ones, ethylene glycol based ones and various finishing agents, are usable for this purpose and suitable selection is made therefrom while taking into consideration the penetratability, degrading effect to the resin or fibers used, durabilities and the like, to say nothing of the softening effect. After the softening agent treatment, it is desirable to apply a mechanical crumpling treatment to enhance the effect of the softening agent. While the skeleton of the present invention has been described above, other modifications and variations can also be employed to obtain high-quality leather-like sheet materials according to the present invention suited for various uses. The leather-like sheet materials of the invention have excellent flexibility, drape and moisture permeability and high-quality surface feeling. Examples of their uses are apparels, gloves, bags, cases, shoes, sports shoes and interiors.

EXAMPLES

Other feature of the invention will become apparent in the course of the following descriptions of exemplary embodiments which are given for illustration of the invention and are not intended to be limiting thereof. In the Examples and Comparative Examples that follow, "parts" and. "%" mean "parts by weight" and "% by weight", respectively, unless otherwise specified.

Example 1

An entangled nonwoven fabric having a weight of 300 g was prepared from multi-component fibers having a dispersoid of 6-nylon incorporating a black pigment kneaded therewith and a dispersion medium of polyethylene (the ratio by weight between the polyamide and polyethylene being 1:1). The fabric was impregnated with a 13% solution of a polyurethane with diol components of polyethylene adipate and polyethylene glycol and containing a black colorant in dimethylformamide (DMF). Then, an excess of the solution on both surfaces was so removed with doctors, as to permit a specified portion thereof to remain on the surfaces. The fabric with the solution was subjected to coagulation treatment in a 25% aqueous DMF solution and, after being dried, the sheet was treated with hot toluene to dissolve off the polyethylene in the multi-component fibers, to give a base layer and, integrated therewith and on each surface thereof, an intermediate coating layer. The base layer comprised a nonwoven fabric from ultrafine fiber-bundle type fibers, each bundle containing collectively about 300 pieces of ultrafine fibers having a single fiber fineness of 0.007 denier, containing the polyurethane in a porous state and, formed on both surfaces thereof, porous polyurethane skin layers having a thickness of about 30 μm and with pores having a maximum pore diameter ranging from 1 to 10 μm. The sheet was then sliced by half, to give two sheets each with the skin layer one one surface thereof. On the surface of one of the sheets thus obtained, three layers of polyurethane resins were applied by dry formation as follows. That is, on a release paper having an embossed pattern there was applied, for a surface skin layer, 70 g/m$^2$ of a liquid obtained by mixing and stirring sufficiently 100 parts of a 25% solution of a silicone-modified ether-based polyurethane (UST-125CP made by Dainippon Ink & Chemicals, Inc.) in dimethylformamide, 7 parts of fine particles of an ammonia-modified maleic anhydride-isobutylene copolymer having a DMF soluble matter content of 20% and having an average particle diameter of 8 μm (hereinafter referred to as "ISOBAN fine particles") and 10 parts of a black pigment, and the paper with the liquid was dried at 80° C. for 1 minutes. Then, there was applied 120 g/m$^2$ of a liquid obtained by mixing and sufficiently stirring 100 parts of a 25% solution of an ether-based polyurethane (ME8105; made by Dainichiseika Colour & Chemicals Mfg. Co.) in dimethylformamide, 10 parts of a black pigment and 50 parts of the same ISOBAN fine particles, which was then dried at 80° C. for 2 minutes. There was further applied, as an adhesive layer, 80 g/m$^2$ of a liquid obtained by mixing and sufficiently stirring 100 parts of a 25% solution of the same ether-based polyurethane as above in dimethylformamide and 10 parts the same ISOBAN fine particles, and the paper with the resins and the adhesive layer was patched with a clearance roll on the intermediate coating layer prepared above and dried at 100° C. for 2 minutes. After ageing for 2 days, the release paper was peeled off. The resulting sheet was treated in a circular water flow dyeing machine at 90° C. for 60 minutes under a relaxed condition, to dissolve off the ISOBAN fine particles, and dried. The sheet thus obtained was treated with a 25% aqueous solution of a silicone-based softening agent (a mixture of NIKKANON/LASTEX made by Nikka Chemical Ind. Co.) by a 2Dip-2Nip process and dried and, further subjected to a mechanical crumpling treatment, to give a leather-like sheet material.

A scanning electron microphotograph with a magnification of 3,000 of was taken of the cross-section in the thickness direction of the dry-formed porous surface coating layer of the sheet material thus obtained and the thickness and the sizes of the pores present on the cross-section were measured. The thickness was 70 μm. In an area of 7,000 μm$^2$, no pores having a maximum pore diameter exceeding 20 μm were observed and the total number of pores having a maximum pore diameter of at least 0.2 μm was 436 pieces, among which 428 pieces (98%) had a maximum pore diameter of not more than 10 μm and 315 pieces (72%) had a maximum pore diameter of not more than 2μ, the average being 1.5 μm.

The sheet material had a particularly good hand, its surface having a high-quality appearance, and luxurious drape and high moisture permeability, thus being markedly suitable for apparels.

Comparative Example 1

Example 1 was repeated except that softening was conducted by the mechanical crumpling treatment alone without the softening agent treatment, to obtain a leather-like sheet material. The sheet material obtained had a little insufficient soft touch and drape, its surface having a high-quality appearance though, when compared with the sheet material obtained in Example 1.

Comparative Examples 2 through 4

Example 1 was repeated except that the thickness of the intermediate coating layer was 0 μm (i.e. not provided), 5 μm or 70 μm, to obtain leather-like sheet materials.

The sheet materials with an intermediate layer having a thickness of 0 μm or 5 μm had a good hand, drape and touch, as well as high moisture permeability, but, their dry-formed surface coating layers having a thickness of 50 μm and 65 μm, respectively, and penetrating into the base layer to a considerable extent, had a poor surface smoothness with many wrinkles in the transverse direction, as compared with the sheet material obtained in Example 1. The sheet material with an intermediate layer having a thickness of 70 μm had a good surface smoothness and had a stiff hand and poor drape and lacked high-quality appearance, the pores of the layer having large maximum pore diameters of 1 to 60 μm.

Comparative Example 5

Example 1 was repeated except that fine gelatin particles having an average particle diameter of 15 μm were used instead of ISOBAN fine particles, to obtain a sheet-like material.

Scanning microscopic observation of the cross-section of the surface coating layer of the sheet material obtained revealed that the thickness was 85 μm and the pores, contained therein had a maximum diameter ranging from 2 to 30 μm with 40% of those of not more than 10 μm and 8% of those of not more than 2 μm. The leather-like Sheet material, being flexible though, lacked good drape and calm touch and lacked high-quality appearance.

Comparative Example 6

A surface coating layer was applied by wet formation on the same base layer with the intermediate layer having a thickness of 5 μm. That is, 350 g/m$^2$ of a 13% solution of an ether-based polyurethane having a 100% modulus of 30 kg/cm$^2$ in DMF was applied on the surface of the intermediate coating layer and coagulated with water at 25° C. On the surface of the obtained layer, an 8% solution Of an ether-based polyurethane containing a black pigment in a mixed solvent of isopropyl alcohol/toluene was applied twice using gravure rolls with 150 mesh. The sheet was then embossed to a sheepskin grain and finally subjected to the same softening treatments as in Example 1, to give a leather-like sheet material.

The sheet material obtained carried a wet-formed porous surface coating layer having a thickness of 70 μm with pores having a maximum pore diameter of as large as 10 to 60 μm. The sheet had a stiffer hand and poorer surface smoothness and lacked high-quality appearance and a lower moisture permeability, as compared with the sheet material obtained fin Example 1.

Comparative Example 7

A moisture permeable porous dry-formed surface coating layer was applied on the base layer with no intermediate layer of Comparative Example 2. That is, on a release paper there was applied 300 g/m$^2$ of a composition liquid containing 100 parts of a solution of a moisture permeable polyurethane (HI-MUREN X-3038; made by Dainichiseika Colour & Chemicals Mfg. Co.), 20 parts of a black pigment, 18 parts of methyl ethyl ketone, 18 parts of toluene, 50 parts of water and as a crosslinking agent a mixture of 2 parts each of RESAMINE X and RESAMINE UM-317 both made by Dainichiseika Colour & Chemicals Mfg. Co., which was dried at 80° C. for 2 minutes. The release paper was then patched on the base layer and further heated at 130° C. for 2 minutes. The sheet material obtained was softened in the same manner as in Example 1, to give a leather-like sheet material.

Scanning electron microscopic observation on the surface coating layer of the sheet material thus obtained revealed that the thickness was 72 μm and the pores contained therein had a comparatively large maximum diameter of 5 to 20 μm and were smaller in number, with only a few of them being continuous.

The sheet material had a little stiffer surface hand and lacked natural folding crease feeling, as compared with the sheet material obtained in Example 1.

Comparative Example 8

Example 1 was repeated except that, in the same dry formation process, an adhesive layer of a conventional 2part type polyurethane was used, to obtain a leather-like sheet material. That is, there was applied as an adhesive layer 80 g/m$^2$ of a liquid obtained by mixing and sufficiently stirring 100 parts of an ether-based polyurethane (UD8310, made by Dainichiseika Colour & Chemicals Mfg. Co.), 30 parts of dimethylformamide, 20 parts of methyl ethyl ketone, 12 parts of a crosslinking agent (NE-KAKYOZAI, made by Dainichiseika Colour & Chemicals Mfg. Co.), an accelerating agent (UD-103, made by Dainichiseika Colour & Chemicals Mfg. Co.) and 30 parts of ISOBAN fine particles having an average particle diameter of 8 μm.

The sheet material thus obtained had poorer hand and touch and considerably lower moisture permeability as compared with the sheet material obtained in Example 1.

Example 2

An entangled nonwoven fabric having a weight of 520 g/m$^2$ from multi-component fibers having a dispersoid of polyethylene terephthalate (average single fiber fineness: 0.003 denier) and a dispersion medium of polyethylene (ratio by weight: 1:1) was impregnated with a 18% solution of a polyurethane with diol components of polyethylene adipate and polyethylene glycol copolymer and containing a blue pigment in dimethylformamide (DMF). Then, the nonwoven fabric was knife-coated on its surface with 40 g/m$^2$ of the same solution. The fabric with the solutions was subjected to coagulation treatment in a 25% aqueous DMF solution and then the polyethylene in the multi-component fibers was dissolved off, to give a base layer and, integrated therewith, a porous intermediate coating layer. The base layer comprised a nonwoven fabric from ultrafine fiber-bundle type fibers and containing the polyurethane in a porous state, and formed on the surface thereof a porous polyurethane skin layer having a thickness of about 20 μm and with pores having a maximum pore diameter ranging from 1 to 15 μm. On the surface of the entire sheet thus obtained, three layers of polyurethane resins were applied by dry formation as follows. That is, on a release paper there was applied, for a surface skin layer, 70 g/m$^2$ of a liquid obtained by-mixing and stirring sufficiently 100 parts of a 25% solution of an ether-based polyurethane (ME8115, made by Dainichiseika Colour & Chemicals Mfg. Co.) and 20 parts of a white pigment, and the paper with the liquid was dried at 80° C. for 1 minute. Then, there was applied as an intermediate layer 150 g/m$^2$ of a liquid obtained by mixing and sufficiently stirring 100 parts of a 25% solution of an ether-based polyurethane (ME8105; made by Dainichiseika Colour & Chemicals Mfg. Co.), 50 parts of the same ISOBAN fine particles as used in Example 1 and 20 parts of the white pigment, which was then dried at 80° C. for 2 minutes. There was further applied, as an adhesive layer, 80 g/m$^2$ of a liquid obtained by mixing and sufficiently stirring 100 parts of a 25% solution of the same ether-based polyurethane as for the above middle layer and 6 parts of the same ISOBAN fine particles, and the paper with the resins and the adhesive layer was patched with a clear-ance roll on the intermediate coating layer prepared above and dried at 100° C. for 2 minutes. After ageing for 2 days, the release paper was peeled off. The resulting sheet was treated in a circular water flow dyeing machine at 100° C. for 60 minutes under a relaxed condition and dried. The sheet thus obtained was treated with an agent for improving surface touch (U-981, made by Seiko Chemicals Co.) by glavure coating in one layer by 100 mesh. The sheet was then softened in the same manner as in Example 1, to give a leather-like sheet material.

A scanning electron microphotograph with a magnification of 3,000 of was taken of the cross-section taken in the thickness direction of the dry-formed porous surface coating layer of the sheet material thus obtained and the thickness and the sizes of the pores present on the cross-section were measured. The thickness was 75 μm. In an area of 7,000 μm$^2$ no pores having a maximum pore diameter exceeding 20 μm were observed and the total number of pores having a maximum pore diameter of at least 0.2 μm was 505 pieces, among which 478 pieces (94%) had a maximum pore diameter of not more than 10 μm and 399 pieces (79%) had a maximum pore diameter of not more than 2 μ, the average being 1.7 μm.

The sheet material had a soft hand with good KOSHI (stiffness), its surface being smooth and having a slimy touch, and a sufficient surface strength and high moisture permeability. The sheet material was very suitable for preparing high-quality sports shows.

The results of evaluation on the leather-like sheet materials obtained in the above Examples and Comparative Examples are summarized in Table 1.

The various properties in Table 1 were measured according to the following JIS's.

Moisture permeability : JIS L1099-A1
Taber abrasion resistance : JIS L1096-6.17.3
Flex resistance : JIS K6545
Thickness : JIS L1096-6.5

The porosity was determined by measuring the area of pores in a cross-section and calculating the ratio between the area and the total area.

In the table, the results of organoleptic evaluation were expressed in terms of the following rating symbols.

◎: excellent
O: good
Δ: fair
X : poor

The taber abrasion resistance and flex resistance were expressed in terms of the following codings.

| Taber abrasion resistance | Flex resistance |
|---|---|
| A: no surface damate | A: no surface cracks |
| B: slight surface damage | B: surface cracks of a small level |
| C: medium suface damage | C: surface cracks of a medium level |
| D: bitter surface damage | D: serious surface cracks |
| E: base layer exposed | E: rupture of base layer |

Obviously, numerous modifications and variations of the present invention are possible in light of the above teachings. It is therefore to be understood that within the scope of the appended claims, the invention may be practiced otherwise than as specifically described herein.

TABLE 1

| Item | Condition and unit | Example 1 | Example 2 | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|---|---|
| Thickness | mm | 0.50 | 1.30 | 0.50 | 0.46 | 0.48 | 0.55 | 0.51 | 0.48 | 0.48 | 0.51 |
| Hand | Organolep- | ◎ | O | Δ | O | O | Δ | O | Δ | Δ | X |

TABLE 1-continued

| Item | Condition and unit | Example 1 | Example 2 | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|---|---|
| | tic test | | | | | | | | | | |
| Drape | Organoleptic test | ○ | ○ | Δ | ○ | ○ | Δ | Δ | X | Δ | X |
| Touch | Organoleptic test | ○ | ○ | Δ | ○ | ○ | ○ | Δ | X | Δ | X |
| High-quality appearance | Organoleptic test | ○ | ○ | ○ | Δ | Δ | ○ | Δ | X | Δ | Δ |
| Folding crease | Organoleptic test | ○ | ○ | ○ | Δ | Δ | ○ | ○ | Δ | Δ | X |
| Apparent density | $g/cm^2$ | 0.430 | 0.425 | 0.401 | 0.428 | 0.417 | 0.421 | 0.390 | 0.365 | 0.397 | 0.415 |
| Porosity of surface coating layer | % | 38 | 41 | 37 | 45 | 39 | 35 | 55 | 28 | 30 | 0 |
| Moisture permeability | ($g/m^2 \cdot 24$ hrs) | 4820 | 4275 | 3950 | 4950 | 4830 | 4120 | 4520 | 2558 | 3599 | 584 |
| Taber abrasion resistance | H-22, 500 g 1,000 times | B | B | B | C | C | B | C | C | B | A |
| Flex resistance | 20° C., 100,000 times | A | A | A | B | A | A | A | A | A | A |

What is claimed is:

1. A highly flexible leather-like sheet material, comprising:

a) a base layer formed by wet coagulation of an elastic polymer and a fibrous aggregate; and provided on the surface thereof, b) a porous intermediate coating layer obtained by wet coagulation of an elastic polymer, said intermediate coating layer being integrated with said base layer and having a thickness of 10 to 40 μm and having continuous pores with a maximum pore diameter of 1 to 30 μm; and provided on the surface thereof, c) a dry-formed porous surface coating layer having a thickness of 20 to 80 μm and continuous pores obtained by extraction of fine particles from a dry formed layer, said pores having a maximum pore diameter of not substantially more than 20 μm; and d) a softening agent;

wherein pore diameter is observed on a cross-section taken in the thickness direction of said sheet.

2. The leather-like sheet material according to claim 1, wherein at least 80% by number of pores among said pores and having a maximum diameter exceeding 0.2 μm have a maximum diameter of not more than 10 μm and at least 50% by number thereof have a maximum diameter of not more than 2 μm.

3. The leather-like sheet material according to claim 1, wherein pores among said pores of said dry-formed porous surface coating layer and having a maximum diameter exceeding 0.2 μm have an average diameter of 1 to 5 μm.

4. The leather-like sheet material according to claim 1, wherein said fibrous aggregate comprises ultrafine fibers having a single fiber fineness of 0.1 to 0.0001 denier or bundles of ultrafine fibers having a single fiber fineness of 0.1 to 0.0001 denier.

5. The leather-like sheet material according to claim 1, wherein each of said elastic polymers is a polyurethane.

6. A process for producing highly flexible leather-like sheet materials, which comprises the steps of:

(a) forming a sheet-like fibrous aggregate;

(b) impregnating the fibrous aggregate with a composition liquid comprising a first elastic polymer and then wet coagulating the composition liquid, to form a base layer;

(c) applying on the surface of the fibrous aggregate a second composition liquid comprising a second elastic polymer and conducting wet coagulation thereof, to form a wet-formed porous intermediate coating layer on the surface of and integrated with the base layer containing the first elastic polymer, said intermediate coating layer having a thickness of 10 to 40 μm and having continuous pores with a maximum pore diameter as observed on the cross-section taken in the thickness direction thereof of 1 to 30 μm;

(d) applying on a release paper a third composition liquid comprising a solution of a third elastic polymer and, mixed therewith, hot water-extractable fine particles, patching the paper with the liquid on the intermediate coating layer formed above, drying the liquid and peeling off the release paper, to form a dry-formed film;

(e) treating the thus formed film with hot water to extract off the hot water-extractable fine particles, to convert the film into a dry-formed porous surface coating layer having a thickness of 20 to 80 μm and having continuous pores with a maximum pore diameter as observed on the cross-section taken in the thickness direction thereof of 0.5 to 20 μm; and (f) applying a softening agent at least to the wet-formed porous intermediate coating layer and the dry-formed porous surface coating layer.

7. The process for producing highly flexible leather-like sheet materials according to claim 6, wherein the step (b) and the step (c) are conducted simultaneously or successively and the wet coagulation of the two composition liquid is effected simultaneously.

8. The process for producing highly flexible leather-like sheet materials according to claim 6, wherein at least 80% by weight of said hot water-extractable fine particles to be mixed with said third elastic polymer have a maximum diameter of 2 to 20 μm.

9. The process for producing highly flexible leather-like sheet materials according to claim 6, wherein said hot water-extractable fine particles used in the step (d) are partially soluble in the solvent used for said third elastic polymer.

10. The process for producing highly flexible leather-like sheet materials according to claim 9, wherein the solubility of said hot water-extractable fine particles in said solvent for said third elastic polymer is 5 to 40% by weight.

11. The process for producing highly flexible leather-like sheet materials according to claim 9, wherein the solution resulting from partial dissolution of said hot water-extractable fine particles in said solvent for said third elastic polymer is present in said third composition liquid while being phase separated from said solution of said third elastic polymer.

12. The process for producing highly flexible leather-like sheet materials according to claim 9, wherein said hot water-extractable fine particles comprise an ammonia-modified maleic anhydride-isobutylene copolymer.

13. The process for producing highly flexible leather-like sheet materials according to claim 7, wherein the step of applying said third composition liquid in the step (d) comprises the steps of successively applying composition liquids of said third elastic polymer and containing different amounts of said hot water-extractable fine particles on said release paper in a plurality of layers.

14. The process for producing highly flexible leather-like sheet materials according to claim 13, wherein said composition liquids are applied at least in at least 3 layers and the amount of said hot water-extractable fine particles contained in the middle layers of said at least 3 layers is larger than that in the top or bottom layer of said at least 3 layers.

* * * * *